United States Patent [19]

Bolton

[11] Patent Number: 4,608,886

[45] Date of Patent: Sep. 2, 1986

[54] KEYLESS DOOR UNLOCKING APPARATUS FOR AUTOMOBILES

[76] Inventor: Ron Bolton, 1038 N. Tustin Ave., Ste. 710, Orange, Calif. 92667

[21] Appl. No.: 785,238

[22] Filed: Oct. 7, 1985

[51] Int. Cl.[4] ..... E05B 63/00

[52] U.S. Cl. ..... 81/15.9; 70/465

[58] Field of Search ..... 81/15.9, 488; 70/465, 70/394

[56] References Cited

U.S. PATENT DOCUMENTS

| | | | |
|---|---|---|---|
| 2,027,009 | 1/1936 | Wyscaver | 81/15.9 |
| 3,438,290 | 4/1969 | Konopacki | 70/465 |
| 4,144,778 | 3/1979 | Waring | 70/465 |

*Primary Examiner*—Roscoe V. Parker

*Attorney, Agent, or Firm*—Gary Appel

[57] ABSTRACT

Apparatus for keyless entry into locked automobiles of the type having a horizontally movable door interior locking linkage comprises a slender, stiff, elongate rod bent through about 90 degrees at the lower end so as to form a short, sidewardly projecting arm. The free end of the arm is bent into an inverted U-shaped hook sized to fit downwardly over the horizontally movable door lock linkage. The upper end of the rod is bent through a small angle in the direction away from the arm and hook so as to form a handle. The upper end of the handle is bent into an open loop, the loop also being directed away from the arm and hook. The entire rod is formed to lie in a single, common place. A thin, flexible wire or cable is connected at one end to the hook and is releasably connected at its other end to the open loop of the handle. The hook is preferably coated with a non-slip material, such as rubber or soft plastic, so that when the hook end of the rod is inserted into an automobile door along the outside of the raised window and into hook engagement with the lock linkage and the handle of the apparatus is twisted, the hook tightly grips the linkage. The upper end of the wire or cable is then released from the handle loop and the wire or cable is pulled along the plane of the window so that the hook pulls the linkage in a manner causing the door to unlock.

13 Claims, 5 Drawing Figures

KEYLESS DOOR UNLOCKING APPARATUS FOR AUTOMOBILES

BACKGROUND OF THE INVENTION

1. Field of Invention

The present invention relates generally to apparatus for enabling keyless entry into locked automobiles without damage to the automobiles, and more particularly to apparatus which is inserted into a locked automobile door along the outside of the door windows and which operationally engages internal linkage portions of the door lock.

2. Discussion of the Prior Art

Many occasions exist in which legal entry into a locked automobile, without use of the automobile's key and without damage to the vehicle, is necessary. It is, for example, a common occurrence for drivers to lock themselves out of their automobiles by inadvertantly locking all the doors with the entry key still in the ignition switch. In other instances, locked and illegally parked automobiles may have to be entered to prepare the vehicle for being towed away. In still other incidences, it may be necessary for authorities to enter locked automobiles to make legal searches for contraband or explosives, to investigate crimes or in some cases to move the automobiles out of the way of emergency equipment.

Although sets of automobile master keys are available to authorized agencies, such master key sets sufficient for entry to all types and models of automobiles are expensive and are not generally made available to the ordinary tow truck operators or security personnel who most commonly face the day-to-day problems of gaining entry into locked automobiles, and although in emergency situations automobile windows can be broken to thus unlock from the inside, such means for entry obviously necessitate replacement of the broken window, usually at considerable cost.

It has, however, long been known by police, tow truck operators and others whose occupations require frequent entry into locked automobiles, that lock linkages inside the vehicles' doors can be manipulated from outside the vehicle in a manner unlocking the door. A common implement for such linkage manipulation is a thin flat, metal strip which can be slipped downwardly alongside a closed door window into the hollow door structure. Such strip, frequently referred to as "Slim Jims", have a notched insertable eye so that the strip can be hooked around a longitudinally extending regions of the lock linkage which is engaged by manually moving the strip back and forth and/or up and down. When the lock linkage is so engaged, a sharp upward tug on the Slim Jim is normally all that is required to actuate the linkage in a manner unlocking the door. In the hands of a skilled and experienced operator, a Slim Jim can be used to unlock most automobile doors as quickly, as can be the factory supplied door key.

As has been discussed above, many automobiles are constructed with inside door locks linkages which, unlock the doors by being pulled upwardly, typical of such types of automobile door locks are those utilizing push-pull lock buttons which project upwardly from the inside window sills. As also mentioned, such types of door locks are capable of manipulating by Slim Jim's such that unlocking of locked doors without damage to the door is generally simple and rapid.

Some types of automobiles, however, use a different type of linkage door locking mechanism which requires a fore and aft, or longitudinal pull, instead of an upward pull, to release the door lock. Exemplary of automobiles using this different type of door locking mechanism are current and recent automobiles of various models manufactured by the General Motors Corporation of the United States. Slim Jims of the type discussed above are ineffective for manipulating such type of lock linkage because no means are provided for gripping the lock linkage tightly enough to enable fore or aft unlocking movement thereof.

At present, there is no type of reasonably inexpensive apparatus, sufficiently thin and flat to permit insertion into an automobile door along the window glass without damage, scratching or breaking the glass or damaging the rain seal around the glass, and which is contructed to enable gripping of the longitudinally movable door lock linkages used, for example, in General Motors' automobiles.

Because of problems associated with keyless entry, without damage to automobiles employing longitudinally movable door lock linkages, the present inventor has invented a new tool which is insertable into an automobile door along the outside of a closed door window. Such tool is configured for releasable gripping engagement with the mentioned type of door lock linkage and provides means for pulling the tool in a longitudinal direction causing the engaged door lock linkage to move in a manner unlocking the door involved.

It is, however, emphasized that the present invention is intended solely for use in a legal manner, by automobile tow truck operations, police and fire personnel and others who have a legal right to enter locked automobiles with or without the owner's permission.

SUMMARY OF THE INVENTION

According to the present invention, apparatus for the keyless unlocking from the outside, of doors of automobiles having an internal door lock linkage which moves in a generally horizontal direction when the door is locked and unlocked, and conversely, the horizontal movement of which in a horizontal direction causes unlocking of the door, comprises an elongate, slender rod sized to slip downwardly into the door along the outside of the door's raised window. Gripping means, connected to the lower end of the rod, and configured for engaging and releasably gripping the horizontally movable door lock linkage, the gripping means being also configured to slip downwardly into the automobile door along the outside of the raised door window. Means are included for pulling, from the outside of the door, the linkage gripping means, and hence the linkage gripped thereby, in the horizontal direction causing unlocking of the door.

Preferably, the gripping means comprise an arm connected at a first end to the lower end of the rod and having formed at the second end thereof an inverted, U-shaped hook sized to fit downwardly over the door lock linkage. Also preferably, the arm is formed by bending the lower end of the rod through about 90 degrees, the rod, the arm, and the hook being generally coplanar.

In one embodiment, the rod is formed having an upper region and a lower region, the upper region being bent through a small angle to the side of the lower region away from the gripping means or arm and so that the upper and lower regions and the gripping means or arm are coplanar. The sidewardly included upper regions of the rod enables an operator to easily pivot the lower region and gripping means or arm connected thereto so as to enable alignment of the hook with the lock linkage. The upper end of the rod upper region may be bent into a loop which is directed away from the gripping means or arm, such loop enabling an easier gripping, by a user, of the rod upper region for manipulating the apparatus.

The means for pulling the hook in a horizontal, door opening direction when the hook is manipulated into engagement with the door lock linkage comprises a thin flexible member, preferably a slender cable, which has its lower end attached to the hook. Preferable the upper end of the flexible member is releasably attached to an upper end region of the rod, preferably to the loop formed at the upper end of the rod. To assist the gripping means or hook in tightly gripping the door lock linkage, a coating of a high coefficient, friction material may be applied to the gripping means or hook.

It is preferred that the arm, hook, and upper and lower region of the rod be formed in one piece with the arm being formed by bending sidewardly the lower end of the rod, the free end of the arm being bent into the inverted u-shaped hook.

BRIEF DESCRIPTION OF THE DRAWINGS

A better understanding of the present invention may be had from a consideration of the following detailed description, taken in conjunction with the accompanying drawings in which:

FIG. 2(*b*) showing the apparatus inserted to a working depth into the automobile door and pivoted through about 90 degrees in preparation for hooking onto a door lock linkage in the door; FIG. 2(*c*) showing the apparatus approximately positioned so that a hook portion of the apparatus is aligned with door lock linkage; and, FIG. 2(*d*) showing the hook portion of the apparatus engaging the door lock linkage with the apparatus twisted so that the hook portion tightly grips the linkage, and showing a cable portion of the apparatus, one end of which is connected to the hook portion, being pulled in a direction causing the hook portion to pull on the lock linkage in the longitudinal direction which unlocks the door.

DESCRIPTION OF THE PREFERRED EMBODYMENT

Figure 1:
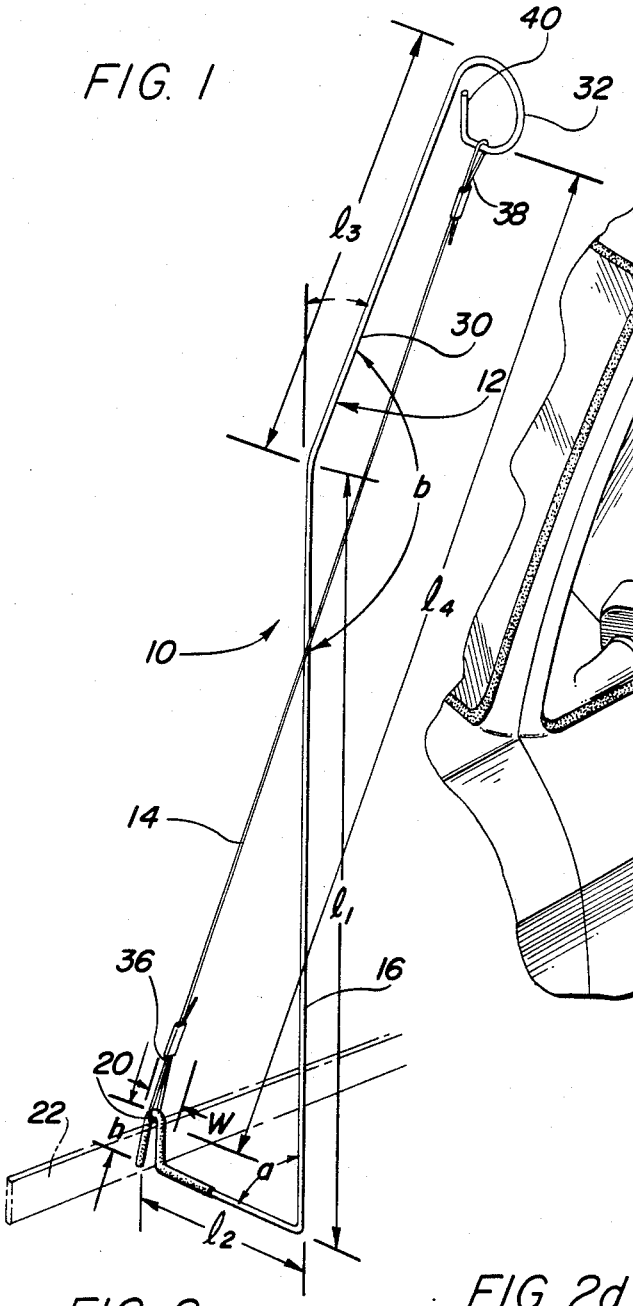
FIG. 1 is perspective drawing of the keyless automobile door unlocking apparatus of the present invention, showing the general configuration thereof; and, FIG. 2 is sequence of pictorial diagrams, showing the manner in which the apparatus of FIG. 1 is operated to unlock an automobile door.
Figure 2A:
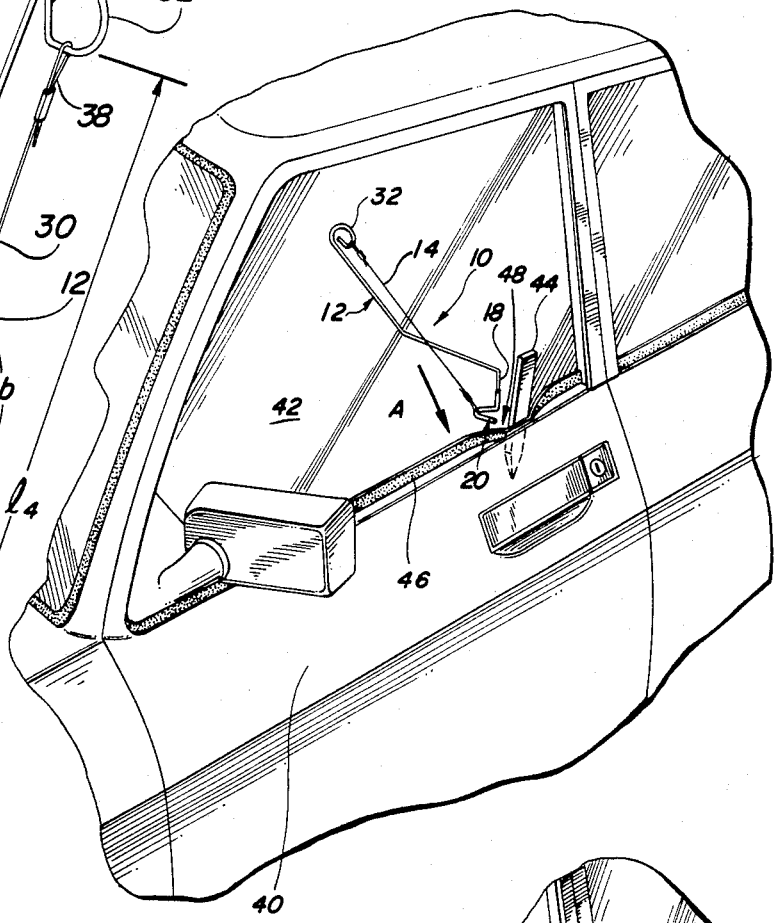
FIG. 2(*a*) showing the apparatus oriented for insertion downwardly into an automobile door along the outside of the door's closed window.
Figure 2B:
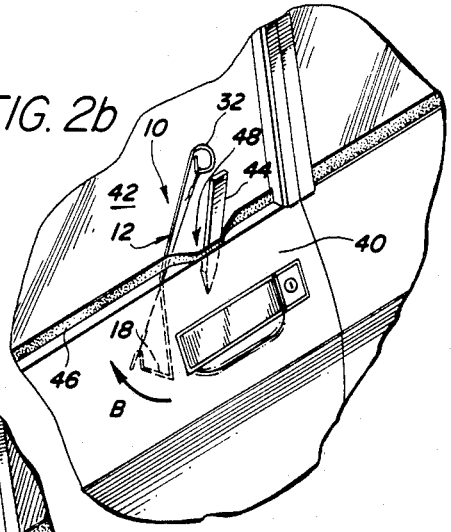
Figure 2C:
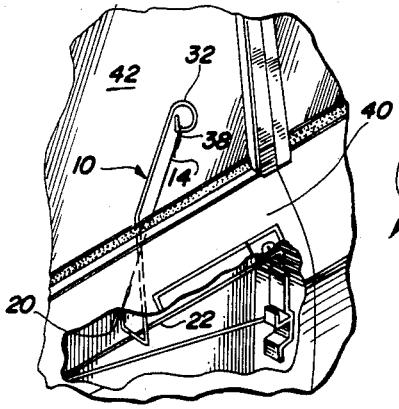
Figure 2D:
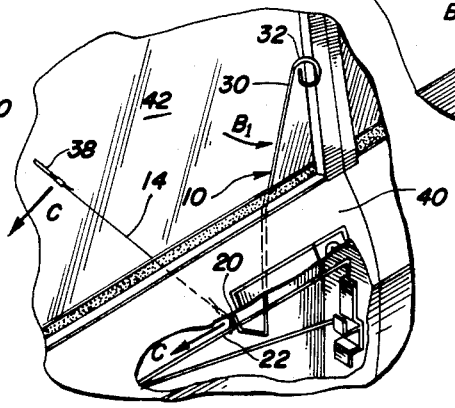

As shown in FIG. 1, an automobile keyless entry apparatus or tool 10 for automobiles, for example, General Motors' automobiles, comprises generally a first, relatively rigid member 12 and a second, flexible member 14. First member 12 is formed for example, of a stiff metal rod about 0.125 inches in diameter, having an elongate insertable, lower portion 16 of length, "l". Formed for example, by bending, the lower ends of lower portion 16 is arm 18 of length "$l_2$" which is much shorter than lower portion length "$l_1$". Preferably angle "a" between lower portion 16 and arm 18 is about 90 degrees.

At the free, outer end of arm 18 is an inverted, U-shaped hook portion 20 sized to fit downwardly over a horizontally (laterally) movable door lock linkage 22 (shown in phantom lines). Hook portion 20 is preferably coated with a high coefficient of friction coating 24, such as a synthetic rubber or soft plastic, which provides a non-slip gripping surface when arm 18 is pivoted, as discussed below, so that hook portion 20 binds against linkage 22 over which the hook portion is downwardly slipped.

The rod from which rigid member 12 is constructed is bent at the upper end of insertable lower portion 16 to form an angularly offset handle portion 30, the upper end of which terminates in an open, generally circular loop 32. Length, "$l_3$" of handle portion 30 is preferably somewhat less than length "$l_1$" of lower portion 16. The angle "b" between lower portion 16 and handle portion 30 may for example, be about 165 degrees, the angle of bend "c" being thereby about 15 degrees.

Rigid member 12 is formed so that all described portions thereof be in a single, common plane, and so that handle portion 30 is inclined away from the direction of arm 18. Member 12 is sufficiently rigid or stiff so that a downward, linkage-gripping push can be applied to hook portion 20 by handle portion 30.

By way of example, with no limitations intended or implied, length "l", of lower portion 16 may be about 12–13 inches; length "$l_2$" of arm 18 may be about $2\frac{3}{4}$ inches and length "$l_3$" of handle portion 30 may be about $6\frac{1}{2}$ inches. Hook portion 20 may be formed having an open width "w" of about $\frac{1}{4}$ inch and a height "h", of about 1 inch. Preferably, as shown, hook portion 20 opens downwardly so that a lower end loop 36 of flexible member 14 can be slipped thereover and be retained thereon during the below-described operation of apparatus 10.

A loop 38 formed at the upper end of flexible number 14 is releasably retained rigid in rigid member loop 32 by a bent up portion 40 of the loop. Length "$l_4$", of flexible member 14 is such that member 14 is tautly stretched when respective lower and upper loops 36 and 38 thereof are retained on hook portion 20 and loop 32. Member 14 may be constructed of wire or thin cable.

OPERATION

The manner in which apparatus 10 is operated or manipulated to open a locked automobile door 40 is depicted in FIGS. 2(*a*)–2(*d*). As shown in FIG. 2(*a*), apparatus 10 is placed flat along the outside of a closed (raised) window 42 of automobile door 40. Apparatus 10 is oriented and angled so that hook portion 20 of apparatus arm 18 is pointed downwardly. A small wedge 44, for example, a pointed and beveled piece of wood, may be used to push aside a conventional, flexible window seal 46 which commonly wipes against the outside of window 42. An opening 48 between the seal 46 and window 42 is thereby provided through which lower portions of apparatus 10 can be inserted downwardly (direction or arrow A) into the interior of door 40 from the outside of the automobile.

After lower portions of apparatus 10 have been inserted downwardly into door 40 through seal opening 48, the apparatus is pivoted to a generally vertical position, drawing FIG. 2(*b*), is then twisted or partially rotated (through about 90 degrees) into the direction of arrow "B" about vertical axis so that arm 18 is about horizontal and is directed inwardly towards the inside of the automobile. It is to be noted in this regard that apparatus 10 is configured so that the bend between rod lower and upper portions 16 and 30 and the crossover point of flexible member 14 about coincide. This enables the described partial rotation of apparatus 10 when the apparatus is inserted to a working depth in door 40 at which the bend and crossover point are approximately located at seal opening 48.

As shown in FIG. 2(*c*), apparatus 10 is then manipulated, by feel, with hook portion 20 comes into engagement with a horizontally movable door lock linkage 22 which extends in a longitudinal fore and aft direction inside of door 40 drawing FIGS. 1, 2(*c*) and 2(*d*). When door lock linkage 22 is firmly engaged by hook portion 20; that is, when apparatus 10 is manipulated so that the hook portion is slipped downward over the linkage, the operator reverse twists or rotates the apparatus [direction of arrow "$B_1$", FIG. 2(*d*)], so that the hook portion binds tightly against the linkage.

With reverse rotational pressure maintained on apparatus 10 to keep linkage 22 tightly wedged in hook portion 20, upper loop 38 of flexible member 14 is removed from rigid member loop 32 (for example, by flexing handle portion 30) and is pulled forwardly, direction of arrow C, by the operator. Such forward pulling of flexible member 14 causes hook portion 20, to which the lower end of member 14 is connected, to also be pulled forwardly. Provided tight gripping engagement is maintained between hook portion 20 and lock linkage 40 (by reverse rotational pressure being applied to handle portion 30), such forward pulling of the hook portion by flexible member 14 causes the linkage also to be pulled forwardly (direction of arrow C), in turn, causing unlocking of door 40. Coating 24 applied to hook portion 20 greatly assists the ability of the hook portion to tightly grip linkage 22.

Although there has been described above an arrangement of a keyless door unlocking apparatus for use with automobiles according to the present invention for the purpose of illustrating the manner in which the invention may be used to advantage, it will be appreciated that the invention is not limited thereto. Accordingly any and all modifications, variations or equivalent arrangements which may ocur to those shelled in the art should be considered to be within the scope of the invention as defined in the appended claims.

What is claimed is:

1. Apparatus for the keyless unlocking from the outside of doors of automobiles having an internal door lock linkage which moves in a generally horizontal direction when the door is locked and unlocked, said apparatus comprising:

a. An elongate, slender rod sized to slip downwardly into an automobile door along the outside of the raised door window;

b. gripping means connected to a lower end of the rod and adapted for engaging and releasably gripping said horizontally movable door lock linkage, said gripping means also being sized to slip downwardly into the automobile door along the outside of the door window; and c. means for pulling from the outside of the door the gripping means in a generally horizontal direction when the gripping means engages and grips said door lock linkage to thereby pull the door lock linkage in the horizontal direction causing the locked door to unlock.

2. The apparatus as claimed in claim 1 wherein said gripping means comprise an arm connected at a first end at about a right angle to the lower end of said rod, the second end of said arm being formed into an inverted u-shape hook for fitting downwardly over said door lock linkage, said rod said arm, and said hook being generally coplanar.

3. The apparatus as claimed in claim 2 wherein the rod is formed having an upper region and a lower region, the rod being configured so that when the lower region is inserted downwardly into an automobile door along the outside of the door window and is twisted until the gripping means engage said door lock linkage, the rod upper region remains outside the automobile door, said upper region and said lower region being at a large angle relative to one another and said upper and lower regions and said arm being substantially in a common plane with said upper region being inclined in a direction away from said arm, said upper region enabling said lower region and said arm to be pivoted after the insertion thereof into the automobile door so as to move the arm inverted U-shaped hook into engagement with the door lock linkage.

4. The apparatus as claimed in claim 3 wherein the free, upper end of the rod upper region is formed into a loop, said loop being substantially coplanar with the rod upper and lower regions and being directed away from said arm, said loop enabling the upper region of the rod to be readily gripped for manipulating the rod and arm.

5. The apparatus as claimed in claim 2 wherein the pulling means comprise an elongate slender member having one end connected to the arm adjacent to inverted U-shaped hook; said member having a length such that when the rod is inserted into an automobile door until said hook engages said door lock linkage, the second end of the member remains outside the automobile door thereby enabling a user to pull thereon so as to move the linkage in a direction unlocking the automobile door into which the apparatus is inserted.

6. The apparatus as claimed in claim 5 wherein said number comprises a slender, flexible cable.

7. The apparatus as claimed in claim 5 wherein said member includes means for detachably connecting the second end thereof to an upper end region of said rod.

8. The apparatus as claimed in claim 2 including a high coefficient of friction coating applied to said inverted U-shaped hook.

9. Apparatus for the keyless unlocking, from the outside of doors of automobiles having an internal door lock linkage which moves in one generally horizontal, longitudinal direction when the door is locked and in an opposite horizontal, longitudinal direction when the door is unlocked, movement of the linkage in said opposite direction, in turn causing the locked door to unlock, said apparatus comprising:

a. an elongate, slender, rigid, rod having an upper region and a lower region said upper region being bent sidewardly relative to said lower region through a small angle;

b. a comparatively short arm having a first end shaped in the general form of an inverted "U" hook and having the second end thereof joined to the lower end of the rod lower region at an angle of about 90 degrees so that the arm, the hook, and the rod upper and lower regions are in a common plane, the rod upper region being bent in a direction away from the arm, said hook being shaped to fit downwardly over said door lock linkage when the rod lower region is inserted downwardly into an automobile door along the outside of the raised door window and the rod is pivoted by the upper region to transversely align the hook with said linkage; and, c. means connected to the hook for enabling a user of the apparatus to pull from outside the door the hook, hence a door linkage gripped thereby, in said opposite direction to thereby cause the unlocking of the locked door.

10. The apparatus as claimed in claim 9 including means for assisting the hook to grip the door linkage, said grip assisting means comprising a coating having a high coefficient of friction applied to the hook.

11. The apparatus as claimed in claim 9 wherein said means connected to the hook comprise an elongate, slender flexible element.

12. The apparatus as claimed in claim 11 wherein the flexible element includes means for releasably connecting the upper end thereof to upper regions of the rod for convenience when inserting lower regions of the apparatus into the automobile door.

13. The apparatus as claimed in claim 9 wherein the rod and the arm are formed in one piece, the arm comprising a sidewardly bent, lower end portion of the rod.

* * * * *